United States Patent [19]

Shiokawa

[11] 4,080,872

[45] Mar. 28, 1978

[54] BOOST VALVE DEVICE

[76] Inventor: Seiji Shiokawa, 110-6 Matsumoto, Mishima, Shizuoka, Japan

[21] Appl. No.: 735,014

[22] Filed: Oct. 22, 1976

Related U.S. Application Data

[63] Continuation of Ser. No. 568,524, Apr. 16, 1975, abandoned.

[51] Int. Cl.[2] ..... F15B 11/08; F15B 13/042

[52] U.S. Cl. ..... 91/436; 137/596

[58] Field of Search ..... 91/436; 137/596

[56] References Cited

U.S. PATENT DOCUMENTS

| | | | |
|---|---|---|---|
| 2,232,514 | 4/1941 | Day | 91/436 X |
| 2,267,284 | 12/1941 | Livers | 91/436 |
| 2,367,682 | 1/1945 | Kehle | 91/436 |
| 2,887,990 | 5/1959 | Rogers | 91/436 X |
| 3,071,926 | 1/1963 | Olson et al. | 91/436 X |
| 3,133,559 | 5/1964 | Tennis | 137/596 |
| 3,299,902 | 1/1967 | Williams | 91/436 X |
| 3,530,883 | 9/1970 | Kramer | 137/596 |

FOREIGN PATENT DOCUMENTS

| | | | |
|---|---|---|---|
| 863,701 | 3/1961 | United Kingdom | 91/436 |

*Primary Examiner*—Irwin C. Cohen
*Attorney, Agent, or Firm*—Kurt Kelman

[57] ABSTRACT

A boost valve device is described which comprises a valve body formed therein with three check valves and hydraulic circuit including the check valves, which circuit functions to recirculate oil discharged from one side of a cylinder during no load operation to the other side of the cylinder to thereby boost the operation velocity of the cylinder under no load operation and to return the discharge oil to an oil tank during load operation. The valve body has an upper surface provided with ports corresponding to ports of a directional control valve and a lower surface provided with ports corresponding to ports of a manifold and is sandwiched between the directional control valve and the manifold with the ports in alignment.

1 Claim, 7 Drawing Figures

Fig. 1
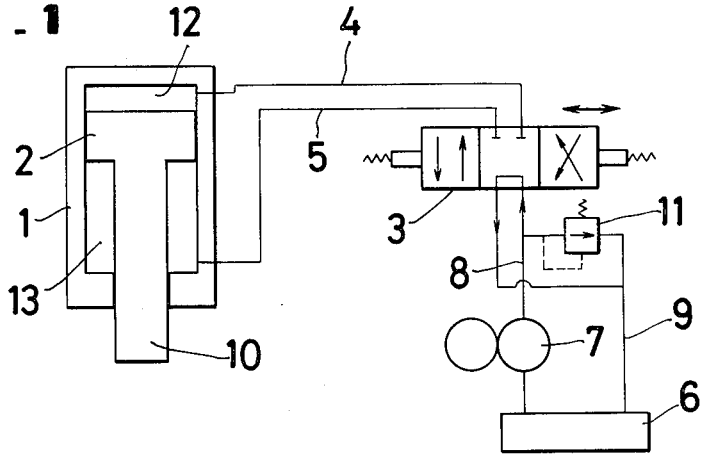
Fig. 2
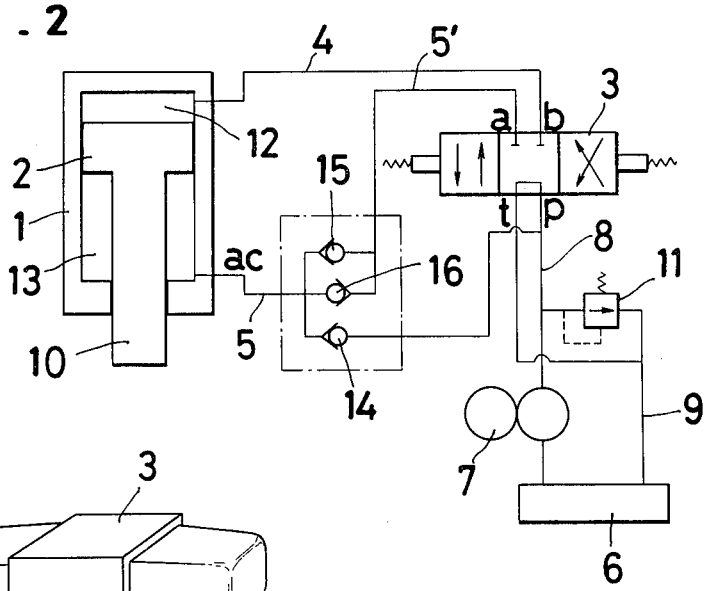
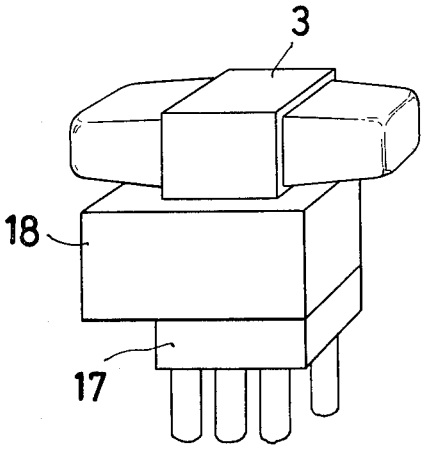
Fig. 4

BOOST VALVE DEVICE

This is a continuation of application Ser. No. 568,524, filed Apr. 16, 1975, and now abandoned.

BACKGROUND OF THE INVENTION

The present invention relates to a boost valve device for a hydraulic cylinder and, more particularly, to a boost valve device which remarkably increases the operation velocity of a reciprocating type hydraulic cylinder under no load and can be readily incorporated in an existing hydraulic cylinder control circuit.

It is well known that the operation velocity of a hydraulic cylinder is proportional to the discharge amount of the hydraulic pump and the horse power of the pump is proportional to the discharge amount and the pressure of the pump used in the circuit.

The hydraulic cylinder is not required to provide a maximum output power throughout its advance stroke and, in general, the loading stroke thereof follows a constant idle stroke. Further, it is usual to use the cylinder intermittently with rest intervals. Therefore, in the past, in order to increase the operation velocity of the oil cylinder with a relatively small pump, it has been usual to lower the discharge pressure of the pump during the idle period to thereby increase the volume of the discharge oil and, during the load period, to increase the pressure of the pump discharge oil to thereby reduce the volume of discharge oil. In practice, there has been used a combination of a low-pressure, large-capacity pump and a high-pressure, small-capacity pump or a variable discharge pump whose discharge amount decreases with increase of pressure. As another approach, a method in which the oil discharged from the pump during the idle period is reserved in an accumulator and used during the load stroke, is also known.

In any of the conventional approaches, the circuit structure becomes large and expensive and, for this reason, such methods are rarely used in hydraulic circuits utilizing relatively small pumps. Although conventional methods are sometimes used in large size hydraulic circuits, there still remain problems of economy.

An object of the present invention is to provide a boost valve device capable of remarkably increasing the operation speed of a reciprocating type hydraulic cylinder during no load operation and thus remarkably improve the operational efficiency of the cylinder.

Another object of the present invention is to provide a boost valve device which can be readily incorporated in any existing hydraulic cylinder circuit.

SUMMARY OF THE INVENTION

In order to achieve the above objects, a boost valve device according to the present invention employs a valve body having an upper surface provided with a plurality of ports to be mated with a corresponding number of ports of a directional control valve and a lower surface provided with a plurality of ports to be mated with a corresponding number of ports of a manifold, three check valves and an associated hydraulic circuit housed in the valve body, and functioning such that return oil from a cylinder is recirculated to the same cylinder during no load operation thereof and is returned to an oil tank only when a load is applied to the cylinder.

Since, when the present boost valve device is incorporated in a hydraulic circuit, the return oil from the cylinder advancing with no load is re-supplied together with supply oil from a pump to the cylinder, the advancing speed is increased and since, when a load is applied, the return oil is returned to the oil tank, the pressurizing ability of the piston is not affected.

Further, due to the provision of the ports on the upper and lower surfaces of the boost valve device, it can be easily incorporated in any of the conventional hydraulic circuits by merely setting it between the directional control valve and the manifold.

Other objects and features of the present invention will become apparent from reading the following description of the present invention with reference to the accompanying drawings.

BRIEF EXPLANATION OF THE DRAWING

FIG. 1 is a circuit diagram of one type of conventional hydraulic cylinder;

FIG. 2 illustrates the principle of the present invention for boosting the piston operation during no load periods, as applied to the circuit in FIG. 1 by the incorporation of three check valves therein;

FIG. 4 is a perspective view of a boost valve device embodying the principle shown in FIG. 2 wherein a single valve body housing the three check valves is used;

DETAILED DESCRIPTION OF THE INVENTION

Figure 3:
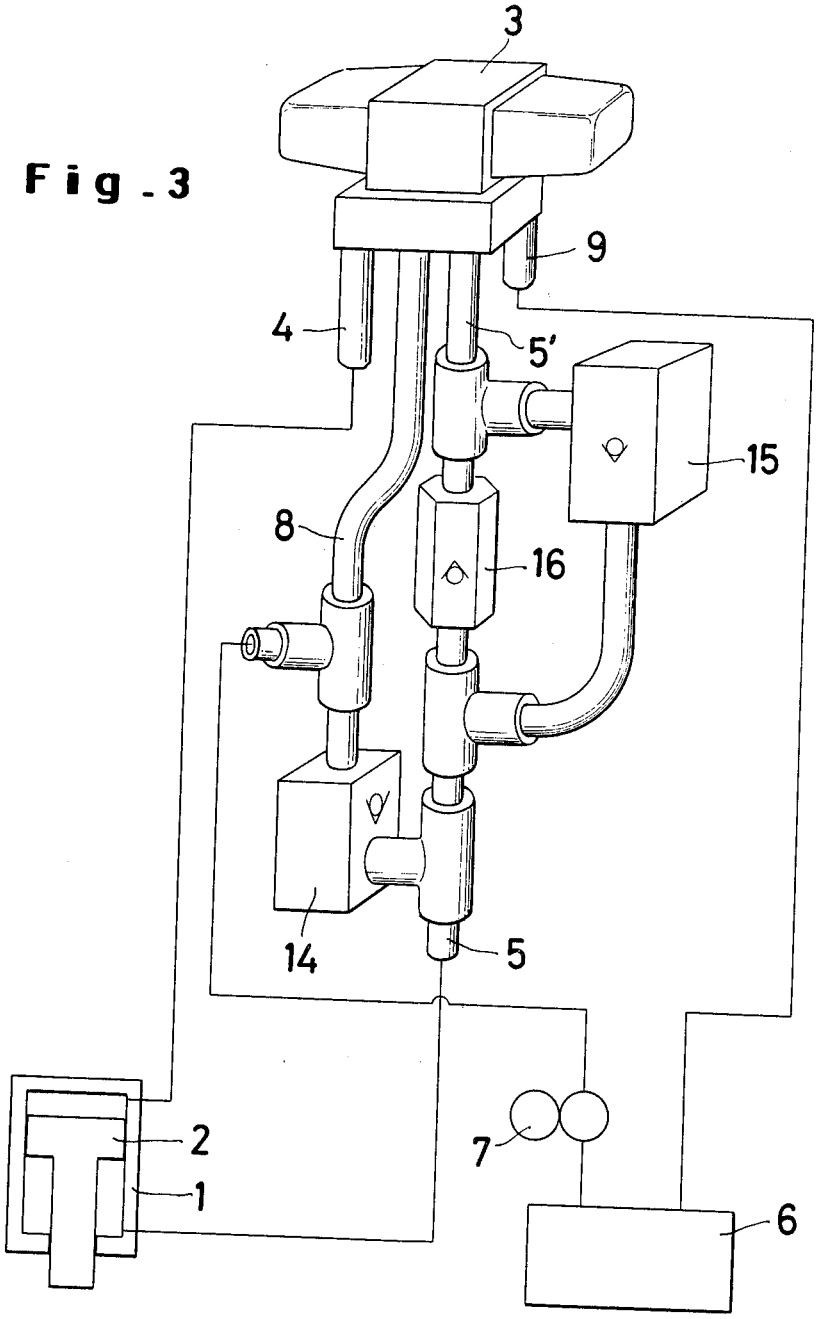
FIG. 3 is a perspective view of a boost valve device embodying the principle shown in FIG. 2 wherein three independent check valves are used.
Figure 5:
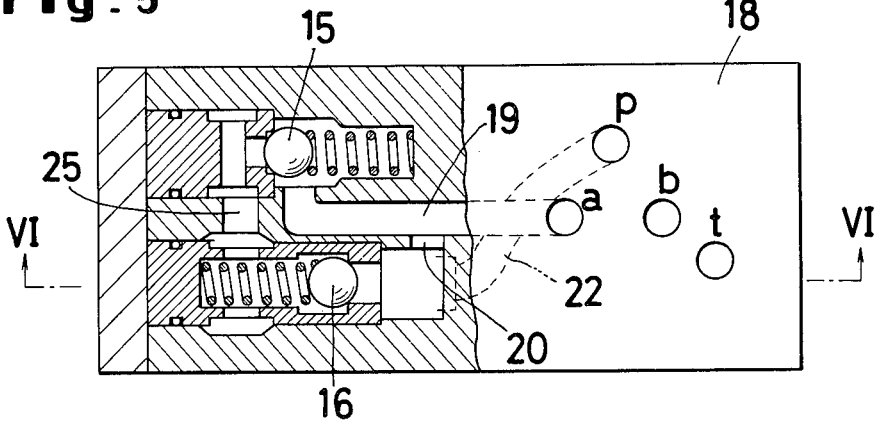
FIG. 5 is a partially broken away plan view of an embodiment of the present boost valve device.
Figure 6:
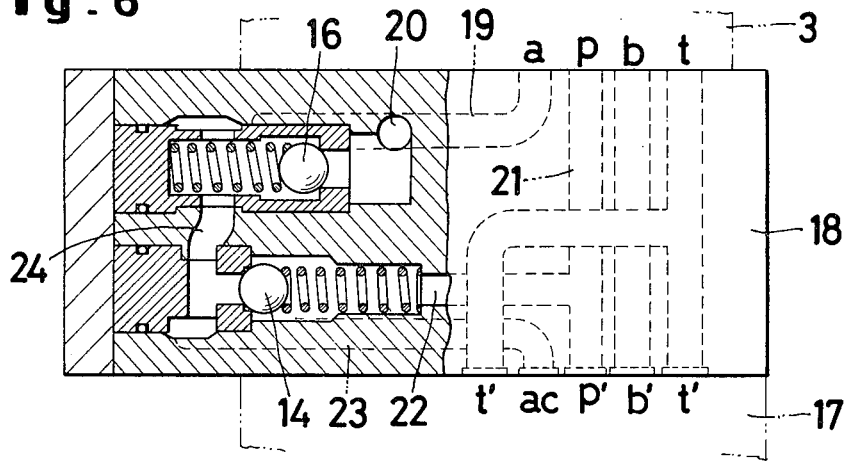
FIG. 6 is a cross sectional side view of the present boost valve device, taken along line VI—VI in FIG. 5.
Figure 7:
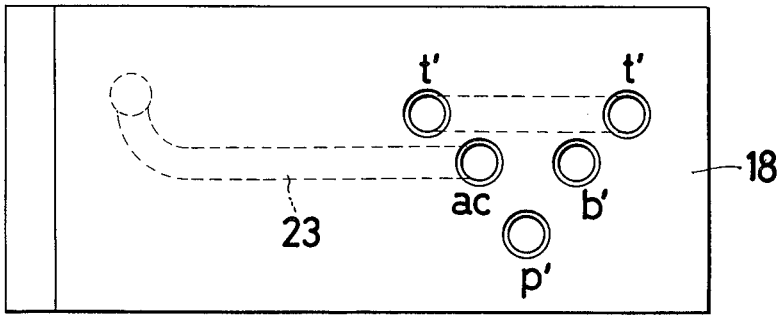
FIG. 7 is a bottom view of the boost valve device in FIG. 5.

In general, in order to actuate a piston 2 of a reciprocating type hydraulic cylinder 1, a directional control valve 3 of known construction is connected through oil pipes 4 and 5 to the upper chamber 12 and lower chamber 13 of the cylinder 1, respectively, and the directional control valve 3 is also connected to an oil tank 6 through a supply pipe 8 including a hydraulic pump 7 and through a return pipe 9. Reference numeral 11 in FIG. 1 shows a safety valve.

Therefore, when the directional control valve 3 is operated so that the oil pipes 4 and 5 are connected to the supply pipe 8 and the return pipe 9, respectively, the oil in the oil tank 6 is forced by the pump 7 through the pipes 8 and 4 to the upper chamber 12 of the cylinder 1 causing the piston 2 to descend to thereby push piston rod 10 downwardly. At the same time the oil occupying the lower chamber 13 of the cylinder 1 is returned through the pipe 5, the valve 3 and the pipe 9 to the oil tank 6.

On the other hand when the directional control valve 3 is operated so that the pipe 8 and the pipe 9 are connected to the pipes 5 and 4 respectively, the oil is fed through the pipes 8 and 5 to the lower chamber 13 of the cylinder 1 causing the piston 2 to be raised and the oil in the upper chamber 12 of the cylinder 1 is returned through the pipes 4 and 9 to the oil tank 6.

In order to boost the movement of the piston 2, various approaches have been proposed and in one typical example a high pressure pump and a relative low pressure pump are provided in combination and the piston velocity when no load is applied thereto is increased by switching the hydraulic circuit so that, when no load is applied to the piston, both of the high and the low pressure pumps feed the oil to the associated cylinder and, when a load is applied, only the high pressure pump feeds the oil to the cylinder. In another example, a pressure accumulator is provided in the hydraulic circuit to accumulate oil energy during idling period (i.e., the period when there is no load on the piston) and to discharge the accumulated energy when a load is applied to the piston to thereby smoothen the piston movement.

FIG. 2 shows a hydraulic circuit for boosting the piston movement which is constituted of a circuit such as that in FIG. 1 wherein there have been incorporated three conventional check valves each having the same construction except for the stiffness of a biasing spring which urges a steel ball to the inlet port thereof to block blind flow with a predetermined cracking pressure. Referring to FIG. 2, a first check valve 14 is provided between the pipes 5 and 8 such that the oil may flow only in the direction from the pipe 5 to the pipe 8, a second check valve 15 is connected between the pipe 5 and the pipe 5' such that the oil may flow only in the direction from the pipe 5 to the directional control valve 3 and a third check valve 16 is connected to the pipe 5 in parallel with but in reverse direction to the second check valve 15. Therefore, the first check valve 14 permits the oil to flow from the pipe 5 to the pipe 8, the second check valve 15 permits oil flow from the pipe 5 to the directional control valve 3 and the third check valve 16 permits oil flow from the directional control valve 3 to the pipe 5. The biasing spring of the first check valve 14 is such as to provide a cracking pressure large enough to hold the weight etc. of the piston 2, the second check valve 15 has a cracking pressure higher than the cracking pressure of the first check valve 14 and the third check valve 16 has a cracking pressure which is independent of the cracking pressures of the first and second check valves.

When the directional control valve 3 is operated so that the oil is forced to the upper chamber 12 of the cylinder 1 by the pump 7, the piston 2 thereof is lowered. At this time the oil in the lower chamber 13 of the cylinder 1 is discharged into the pipe 5 and passes through the first check valve 14, due to the difference in cracking pressure between the check valves 14 and 15, to the pipe 8. The oil passing through the first check valve flows into the oil flow from the pump 7 at the pipe 8 and the confluence of oils is forced into the upper chamber 12 of the cylinder 1. Thus the oil discharged from the cylinder 1 is not returned to the oil tank but forced together with the oil from the pump into the upper chamber of the cylinder to thereby boost the downward movement of the piston 2.

Where the oil feeding amount of the pump 7 is represented by "Q" ($cm^3$/sec), the cross sectional area of the piston rod 2 by "A" ($cm^2$) and the sectional area of the piston rod 10 by "$a$" ($cm^2$), the downward velocity $V_1$ (cm/sec) of the piston 2 in the circuit shown in FIG. 1 is given by the following equation:

$$v_1 = Q/A$$

On the other hand, in the circuit in FIG. 2 in which the boost valve means is incorporated, since the amount of the oil to be forced to the upper portion of the cylinder 1 increases in proportion to the downward velocity $V_2$ (cm/sec) of the piston 2, the following equation is established:

$$V_2 = \frac{Q + (A - a)V_2}{A}$$

and therefore $$v_2 = Q/a$$

Consequently, the downward velocity $V_2$ of the piston 2 in the circuit having the boost valve means incorporated therein can be considered to be the same as that obtained when only the piston rod 10 is actuated with the feeding amount Q of the pump.

Since the area "A" of the piston 2 is generally larger than the area "$a$" of the rod 10 and the ratio between them is ordinarily about $A:a = 3:1$, then $V_1:V_2 = 1:3$ and thus the piston velocity under no load condition is increased by $A/a$ times, i.e., about 3 times by merely incorporating the boost valve means.

Since, when the piston rod 10 contacts and pushes a workpiece, the oil continues to be forced by the pump 7, the hydraulic pressure in the cylinder 1, the pipe 8 and the pipe 4 is increased.

When the hydraulic pressure in the pipe 8 exceeds the cracking pressure of the second check valve 15, the oil discharged from the lower chamber 13 of the cylinder 1 flows from the second check valve 15 through the directional control valve 3 and the pipe 9 to the oil tank 6. Therefore, the piston 2 is pressurized by the oil from the pump 7 over the whole area thereof and the pressure force exerted on the piston rod 10 is not decreased, so that the piston 2 is accelerated only when no load is applied.

When, by operating the directional control valve 3, the pipe 8 and the pipe 9 are connected to the pipes 5 and 4, respectively, the oil from the pump 7 is forced through the third check valve 16 and the pipe 5 to the lower chamber 13 of the cylinder 1 to thereby cause the piston 2 to be raised. At this time, the oil in the upper chamber 12 of the cylinder 1 is returned through the pipe 4 and the pipe 9 to the oil tank 6.

FIG. 3 is a perspective view of the simplest arrangement of the three independently formed check valves 14, 15 and 16 with the connecting pipes therebetween. In this case, at least four joints and several pipes are required to complete the arrangement. Therefore this arrangement has disadvantages in that the piping work is troublesome and there is a possibility of oil leakage due to the additional threaded parts and/or the welding required to complete the hydraulic circuit. This arrangement is not practical because of the above mentioned disadvantages and further because of the relatively large space required to house the increased number of parts.

Although the incorporation of three check valves in the hydraulic circuit provides a remarkable effect on the operation velocity of the piston as mentioned previously, its mechanical construction becomes complicated and for this reason, its practical application has been considered as difficult. In view of this, the inventor investigated ways to simplify the mechanical construction of the boosting circuit and found that, by utilizing the fact that the directional control valve 3 is ordinarily piped through a manifold 17 and the positions of the respective ports of the directional control valve 3 are standardized according to type, size etc., it becomes possible to sandwitch a boost valve means housing integrally therein the three check valves and associated fluid paths between the directional control valve 3 and the manifold to simplify the mechanical construction thereof to thereby facilitate the incorporation thereof in an existing hydraulic circuit.

A preferred embodiment of the boost valve means according to the present invention will now be described with reference to FIGS. 4 to 7.

On an upper surface of a valve body 18 (FIG. 5), which intimately contacts the directional control valve 3, a port *a* for connection to the directional control valve 3, a port *b* for connection to the pipe 4, a port *p* for connection to the pipe 8 and a port *t* for connection to the pipe 9 are provided at positions corresponding to those of the valve 3 respectively and, on a lower surface of the valve body 18 (FIG. 7), a port *ac* for connection to the pipe 5, a port *b'* directly connected to the port *b*, ports *t'* branched from the port *t* and a port *p'* are provided at positions corresponding to those of the manifold 17 respectively.

The three check valves 14, 15 and 16 which, similarly to the conventional check valve, each comprises a steel ball, a valve seat, a coil spring for providing the cracking pressure by urging the steel ball onto the valve seat and an oil reservoir etc., are formed in the interior of the valve body 18 such that the second check valve 15 and the third check valve 16 are positioned horizontally in parallel in the upper portion of the valve body 18 and the first check valve 14 is positioned below the third check valve 16. The port *a* is connected through a path 19 to the spring side of the second check valve 15 and through a path 20 branched from the path 19 to the steel ball side of the third check valve 16. The port *p* is connected through a path 21 having a branch point to port *p'* opened in the lower surface of the valve body 18. The branch point of that path 21 is connected through a path 22 to the spring side of the first check valve 14. The port *ac* in the lower surface of the valve body is connected through a path 23 to the steel ball side of the first check valve 14. The steel ball side of the first check valve 14 is also connected through a path 24 to the steel ball side of the second check valve 15 and the steel ball side of the second check valve 15 is connected through a path 25 to the spring side of the third check valve 16.

The purpose of the port *t'* in the lower surface of the valve body, which is branched from the port *t* in the upper surface, is to make the present boost valve means capable of being accommodated to an ordinary small size electromagnetic directional control valve which has two manifolds at two different positions.

The boost valve device is disposed between the directional control valve 3 and the manifold 17 and the ports of the directional control valve 3 and the manifold 17 are connected to the respective ports of the boost valve device in such a manner that oil leakage is prevented. Leakage of oil can be prevented, for example, by setting the boost valve device between the directional control valve and the manifold in a sandwitch construction using packings to seal the ports and then bolting the directional control valve 3 and the boost valve device to the manifold to form single assembly make the connection of the ports complete.

When the port *p* and the port *a* are connected to the port *b* and the port *t* respectively by operating the directional control valve 3, the oil fed from the oil tank 6 is pressurized by the pump 7 and supplied through the pipe 8 to the port *p'*. The oil then passes from the port *p* through the interior of the directional control valve 3, through the port *b* to the port *b'* and through the pipe 4 into the upper chamber 12 of the cylinder 1. The oil discharged from the lower chamber 13 of the cylinder 1 with the downward movement of the piston 10 in the cylinder 1 is fed through the pipe 5 to the port *ac*. As mentioned previously, the port *ac* communicates with the steel ball side of the first check valve 14, the steel ball side of the second check valve 15 and the spring side of the third check valve 16 and the oil tends to flow into the first and the second check valves. However, since, with no load on the piston, i.e., when no pressure is exerted in the pipe 8, the cracking pressure of the first check valve 14 is lower than that of the second check valve 15, the oil is permitted to flow through the first check valve and into path 22 to join with the oil from the oil tank, and the confluent oil is circulated to the upper chamber 12 of the cylinder 1 through the pipe 4. Therefore, the velocity of the piston with no load is accelerated. On the other hand, when a load is applied to the piston, the hydraulic pressure supplied through the pipe 8 is also increased gradually and thus the pressure on the first check valve increases. When the pressure on the first check valve exceeds that of the second check valve, the oil discharged from the cylinder is directed to the second check valve and flows through the path 19, the port *a*, the directional control valve, the port *t*, the port *t'* and the pipe 9 to the oil tank 6.

When, by operating the directional control valve 3, the ports *p* and *t* are connected to the ports *a* and *b* respectively, the oil flows through the path 21, the port *p*, the valve 3 and the port *a* to the third check valve 16 and then through the port *ac* and the pipe 5 to the lower chamber 13 of the cylinder 1 causing the piston thereof to rise. The oil in the upper chamber 12 of the cylinder is discharged therefrom and passes through the pipe 4, the ports *b'* and *b*, the directional control valve, the ports *t* and *t'* and the pipe 9 to the oil tank 6.

In this manner, the boost valve device according to the present invention houses all of the hydraulic circuits required to boost the piston and functions in the same manner as in the construction shown in FIG. 3.

In fabricating the present boost valve device, it is sufficient to bore holes in a suitable metal block to form the various paths and chambers for mounting the check valves, to mount the check valves in the desired locations and finally to seal the block. Of course, the metal block having the holes may be fabricated by casting instead of by boring.

The embodiment mentioned above comprises a valve body including therein a second check valve and a third check valve disposed horizontally and parallel with the second check valve, and a first check valve disposed below the third check valve. The arrangement of the three check valves is not limited to this embodiment and many modifications thereof may be considered. For example, the three check valves may be arranged in zig-zag manner or may be arranged in series manner. In such modification, the fluid paths to be formed in the metal block may become relatively complex.

As is obvious from the foregoing description, the present invention comprises a valve body in the upper surface of which a plurality of ports are formed at positions corresponding to those of ports of a directional control valve, in the lower surface of which ports are formed at positions corresponding to those of ports of a manifold or a sub-plate and in the interior of which three check valves and associated fluid paths are mounted and formed, the valve body being sandwitched between the directional control valve and the manifold and bolted as an assembly.

Therefore, the work of providing piping is eliminated and the possibility of increased oil leakage is eliminated. In addition to these advantages, the present boost valve device is so compact that it can be easily adapted for use with either existing hydraulic equipment or newly designed equipment. Furthermore, the remarkably boost in the oil pressure cycle obtained by this device is obtained without modifying the performance characteristics of the pump used in conjunction therewith.

What is claimed is:

1. A hydraulic fluid pressure control device for controlling the operation of a hydraulic cylinder having a piston and a rod affixed to the piston, the piston dividing the cylinder into an upper chamber and a lower chamber, a hydraulic fluid supply including a hydraulic fluid tank, a pump connected to the tank for receiving hydraulic fluid therefrom, fluid conduit means between the pump and the cylinder, the conduit means comprising a first conduit leading to the upper chamber, a second conduit leading to the lower chamber and a return leading to the tank, a directional control valve mounted in the conduit means and having respective ports communicating with the first and second conduits, the valve being operable between a first position wherein the pump is connected to the first conduit to supply hydraulic fluid to the upper cylinder chamber and the second conduit is connected to the return conduit, and a second position wherein the pump is connected to the second conduit to supply hydraulic fluid to the lower cylinder chamber and the first conduit is connected to the return circuit, a boost valve body assembled in abutting engagement with the directional control valve and having two opposite surfaces, the surfaces defining a plurality of ports, respective ones of the ports in the directional control valve being in fluid-tight assembly with the ports in one of the surfaces of the boost valve body, and a manifold assembled in abutting engagement with the boost valve body, the manifold having a plurality of ports in fluid-tight assembly with the ports in the oppisite surface of the boost valve body, one of the manifold ports being connected to the pump, the boost valve body defining between respective ports in the opposite surfaces thereof three fluid flow passages permitting fluid flow from the second conduit through the passages controlled solely by a respective check valve in each of the passages, each check valve comprising a ball and a spring biasing the ball into a normally closed position, a first one of the passages connecting the second conduit to the pump, second and third ones of the passages connecting the second conduit to the control valve, first and second ones of the check valves in the first and second passages, respectively, being spring-biased in the direction of the second conduit, the second check valve being biased under a pressure exceeding the biasing pressure of the first check valve, and the third check valve in the third passage being spring-biased in the direction of the control valve, whereby hydraulic fluid flowing out of the lower cylinder chamber through the second conduit in the first position of the control valve flows through the first passage and opens the first check valve to continue flow towards the pump, this hydraulic fluid flow being added to the hydraulic fluid being delivered by the pump to the first conduit to boost the fluid supply to the upper cylinder chamber and thus to accelerate the piston velocity.

* * * * *